United States Patent [19]

Ikrath et al.

[11] 4,008,478

[45] Feb. 15, 1977

[54] RIFLE BARREL SERVING AS RADIO ANTENNA

[75] Inventors: Kurt Ikrath, Elberon; William Kennebeck, Sea Bright; Jack Wills, Ocean Grove, all of N.J.

[73] Assignee: The United States of America as represented by the Secretary of the Army, Washington, D.C.

[22] Filed: Dec. 31, 1975

[21] Appl. No.: 645,722

[52] U.S. Cl. ..... 343/720; 343/895

[51] Int. Cl.[2] ..... H01Q 1/00; H01Q 1/36

[58] Field of Search ..... 343/720, 856, 908, 895

[56] References Cited

UNITED STATES PATENTS

| | | | |
|---|---|---|---|
| 1,284,155 | 11/1918 | Shartzer | 343/720 |
| 2,296,356 | 9/1942 | Lindenblad | 343/856 |
| 3,646,562 | 2/1972 | Acker et al. | 343/720 |

*Primary Examiner*—Eli Lieberman

*Attorney, Agent, or Firm*—Nathan Edelberg; Sheldon Kanars; Edward Goldberg

[57] ABSTRACT

A toroidal coil mounted around the barrel of a rifle permits the rifle to act as a camouflaged antenna for a VHF transceiver.

4 Claims, 2 Drawing Figures

RIFLE BARREL SERVING AS RADIO ANTENNA

GOVERNMENT LICENSE

The invention described herein may be used by or for the Government for governmental purposes without the payment of any royalties thereon or therefor.

BACKGROUND OF THE INVENTION a. Field of the Invention

Broadly speaking, this invention relates to radio antennas. More particularly, in a preferred embodiment, this invention relates to a camouflaged radio antenna for use by military personnel and the like.

b. Discussion of the Prior Art

As is well known, in modern military warfare it is essential that combat personnel have at all times the capability of contacting the command post and/or other friendly personnel. It is, thus, routine to assign one or more radiomen to each platoon or squad, each radioman typically being equipped with a VHF walkie-talkie or similar transceiver.

Unfortunately, the whip antennas furnished with such transceivers are substantially effective only when vertically oriented and this makes the radio operator a prime target for enemy sniper fire because the enemy knows only too well how vital communications are to a combat platoon.

This, of course, is not the only problem with prior art procedures. Since it is unwise to leave the radio operator defenseless, he too must be equipped with a rifle; but, the rifle tends to make it difficult for the operator to use his transceiver. Likewise, the transceiver and its antenna, in particular, makes it extremely awkward for the operator to aim and shoot his rifle.

The problem, then, is to devise a transceiver configuration that renders the antenna substantially invisible to the enemy and which does not interfere with the operation of the radio operator's rifle, or vice-versa, all without substantially degrading the performance of the transceiver.

SUMMARY OF THE INVENTION

Fortunately, the above and other problems have been solved by the instant invention which, in a preferred embodiment, comprises in combination a weapon having an elongated electrically-conductive barrel, a radio-frequency transceiver mounted to the weapon and means for coupling the r.f. output of the transceiver to the barrel whereby the barrel acts as the antenna for the transceiver.

The invention and its mode of operation will be more fully understood from the following detailed description, when taken with the appended drawings, in which:

DESCRIPTION OF THE DRAWINGS

Description of the Drawings

Figure 1:
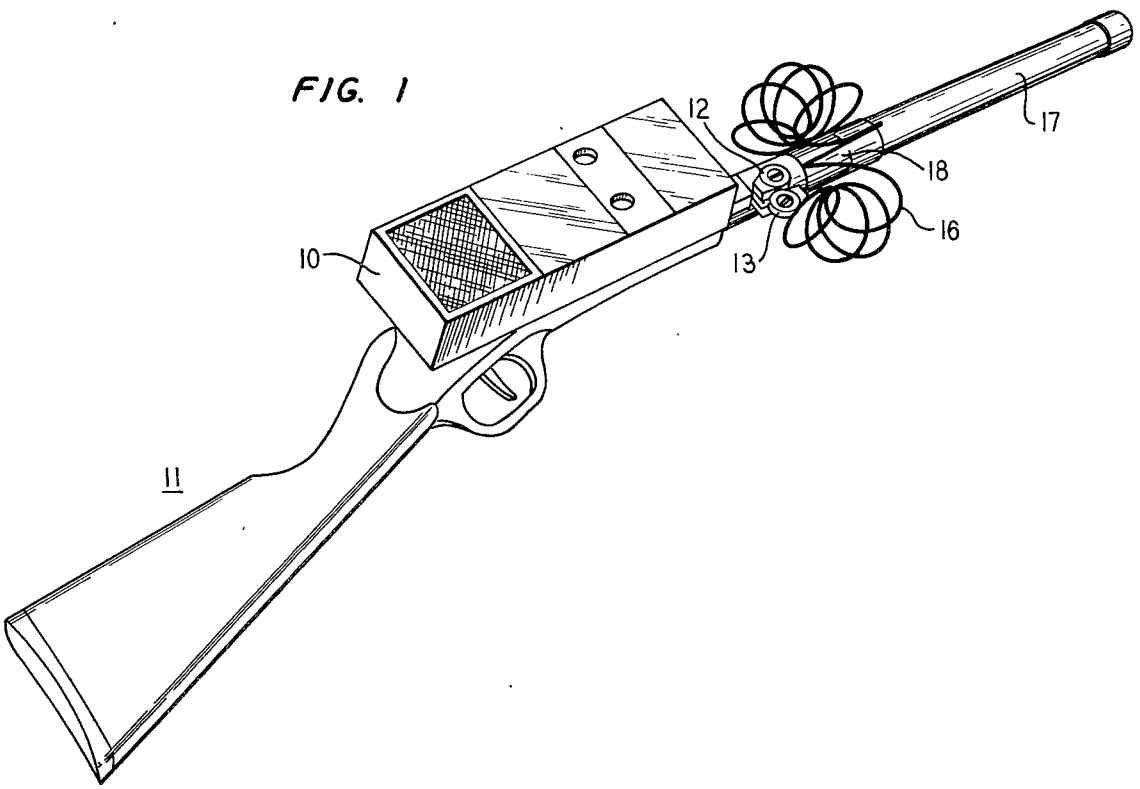
Figure 2:
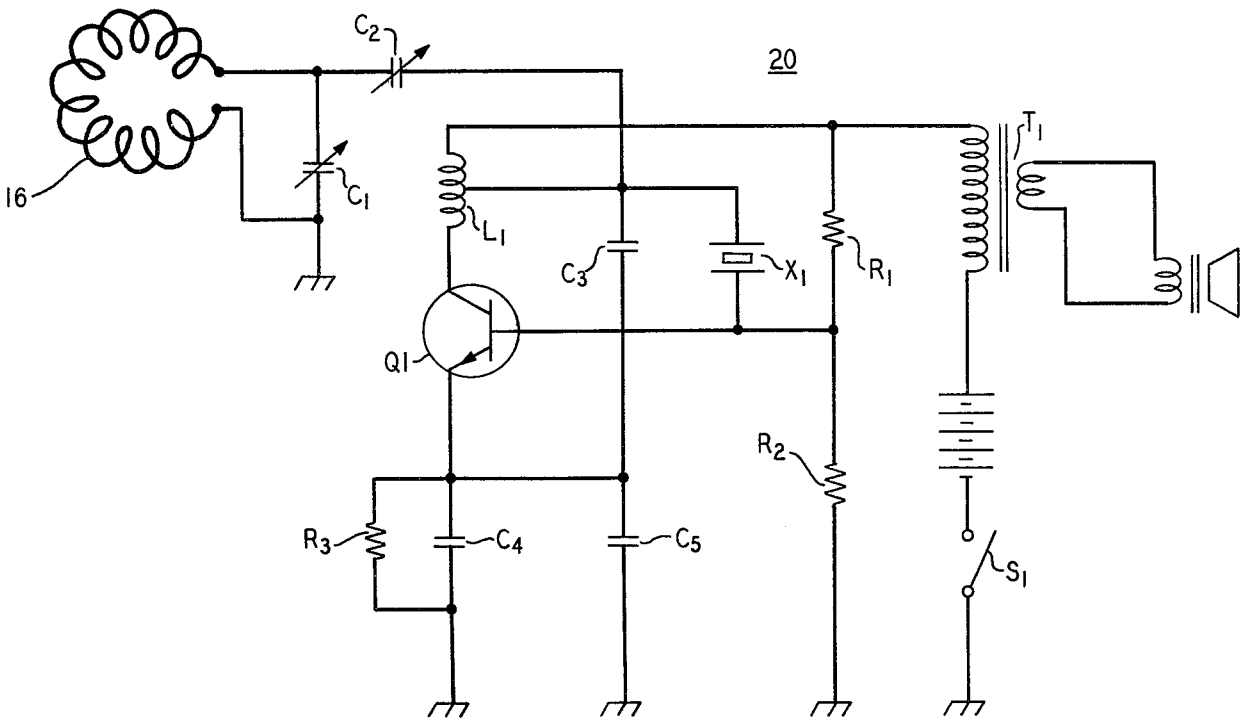

FIG. 1 is an isometric view of a first illustrative embodiment of the invention; and FIG. 2 is a schematic drawing of an illustrative transmitter for use with the apparatus shown in FIG. 1.

DETAILED DESCRIPTION OF THE INVENTION

FIG. 1 depicts an illustrative embodiment of the invention. One skilled in the art will appreciate that many variations are possible without departing from the spirit and scope of the invention. As shown, a transceiver 10 is fastened by some suitable means, not shown, to the stock of a rifle or other similar weapon 11. Transceiver 10 is connected, via a pair of trimmer capacitors 12, 13, to a HEMAC coil antenna 16 which is co-axially mounted about the lower end of the barrel 17 of rifle 11. An insulator 18 about barrel 17 prevents the turns of coil 16 from shorting.

In the arrangement shown in FIG. 1, the rifle acts as an electrical whip antenna for the transceiver, the antenna being connected to the transceiver by a leaky RF transformer. The magnetic leakage induction field from this transformer becomes the effective means for launching the RF signal when the whip antenna becomes ineffective, e.g., when the rifle is close to the ground or held horizontally.

FIG. 2 depicts an illustrative transmitter for the rifle. It will be understood that many other configurations are possible. As shown, transmitter 20 comprises a tuned r.f. oscillator comprising a power transistor Q1 and a tapped coil $L_1$. The frequency of the oscillator is determined by a quartz crystal $X_1$ and a capacitor $C_3$. The oscillator is modulated via audio frequency signals applied to the collector of Q1 from modulation transformer $T_1$. The barrel 17 of gun 11 acts as a low impedance secondary load in a resonant toroid transformer circuit, HEMAC coil 16, the high impedance primary winding of which is coupled to the output of transmitter 20 by a series capacitor $C_2$and a parallel capacitor $C_1$, both advantageously trimmer capacitors (12 and 13 in FIG. 1). In operation, $C_1$and $C_2$are adjusted to match the output impedance of the transmitter to the barrel of the rifle. Since the radioman's body acts as a counterpoise for the whip antenna, it is difficult to make accurate and repeatable impedance measurements; however, typical values are about 100 ohms with a phase angle of up to −40°.

Obviously, results will vary from weapon to weapon and are a function of the frequency employed. If the gun barrel is too short for the desired frequency, the barrel may be electrically extended, care being taken that the extension does not affect the actual operation of the weapon. If the barrel is electrically too long, then the position of coil 16 may be changed to obtain the desired impedance match and radiation pattern.

A series of experiments were conducted on two guns, one having a barrel considerably longer than the other. The frequency employed was 27.175 MHz and the nominal output power was 100 MW. The performance of the gun-antennas was evaluated relative to the performance of the same transmitter using a conventional whip antenna. The performance of the respective radiators is expressed in terms of the emitted vertical electrical field intensity (in dB), relative to 1 $\mu$V/meter as measured on a commercial field-intensity meter.

TABLE 1

| SIGNAL AND NOISE LEVELS IN dB/1 microvolt | | | | | | |
|---|---|---|---|---|---|---|
| POSITION OF XMTR OPERATOR | KNEELING | | | STANDING | | |
| ORIENTATION OF RADIATOR | VERTICAL | HORIZONTAL | | VERTICAL | HORIZONTAL | |
| | | FACING | BROADSIDE | | FACING | BROADSIDE |

TABLE 1-continued

| SIGNAL AND NOISE LEVELS IN dB/1 microvolt | | | | | | |
|---|---|---|---|---|---|---|
| TYPE OF RADIATOR and FREQUENCY | | | | | | |
| SHORT BARREL GUN, 27.075 MHz | 35 | 33 | 34 | 39 | 36 | 37 |
| LONG BARREL GUN, 27.175 MHz | 41.5 | 32 | 35 | 35 | 41 | 39 |
| CONVENTIONAL WHIP, 27.175 MHz | 39.5 | 31 | 32 | 41.5 | 34 | 36.5 |

Remarks:
Noise Level = 15 dB/$\mu$V For conversion to Field Intensity (Evert in dB relative to 1 $\mu$V/m) add + 5.8 dB.

TABLE 2

| FIELD INTENSITY LEVELS $E_z$ in dB rel. 1 $\mu$V/m and in $\mu$V/m derived from S + N and N levels | | | | | | |
|---|---|---|---|---|---|---|
| POSITION OF XMTR OPERATOR | KNEELING | | | STANDING | | |
| ORIENTATION OF RADIATOR | VERTICAL | HORIZONTAL | | VERTICAL | HORIZONTAL | |
| | | FACING | BROADSIDE | | FACING | BROADSIDE |
| TYPE OF RADIATOR and FREQUENCY | | | | | | |
| SHORT BARREL GUN, 27.075 MHz | 38.8 dB = = 110 $\mu$V/m | 39.8 dB = = 87 $\mu$V/m | 44.8dB = = 100 $\mu$V/m | 41.8 dB = = 174 $\mu$V/m | 42.8 dB = = 122 $\mu$V/m | = 138 $\mu$V/m |
| LONG BARREL GUN, 27.075 MHz | 47.3 dB = =230 $\mu$V/m | 37.8 dB = = 79 $\mu$V/m | 40.8 dB = =110 $\mu$V/m | 40.8 dB = =110 $\mu$V/m | 46.8 dB = =220 $\mu$V/m | 44.8 dB = =174 $\mu$V/m |
| WHIP 27.175 MHz | 45.3 dB = =190 $\mu$V/m | 36.8 dB = = 69 $\mu$V/m | 37.8 dB = = 79 $\mu$V/m | 47.3 dB = = 230 $\mu$V/m | 39.8 dB = = 100 $\mu$V/m | 42.3 dB = = 130 $\mu$V/m |

Remarks:
Overall length of radiators
Short barrel gun = 30 inches
Long Barrel gun = 50 inches
Whip (33") + case = 39 inches Taking the average of the field intensity levels in $\mu$V/meter for the three different radiator orientations in the standing and kneeling position of the transmitter operator, one arrives at the following average performance data.

TABLE 3

| RADIATOR | KNEELING | STANDING |
|---|---|---|
| Short Barrel Gun | 99 | 145 |
| Long Barrel Gun | 140 | 168 |
| Conventional Whip | 111 | 154 |

The consistency of these results is recognized by the approximately 30 –40 $\mu$V/meter gain in the standing position over the kneeling position. These tables prove that, on the average, the use of a rifle barrel as a radiator yields superior results than a conventional whip alone.

Although the invention has been disclosed in a military context, one skilled in the art will appreciate that it also has civilian applicability. For example, by the police or state troopers or by hunters, et cetera. Further, one skilled in the art will appreciate that various changes and modifications may be made without departing from the spirit and scope of the invention.

What is claimed is:

1. In combination:

a. a weapon having an elongated, electrically-conductive barrel;

b. a radio-frequency transceiver providing an r.f. output and being mounted to said weapon;

c. a helical toroidal r.f. transformer coil co-axially mounted about said barrel and coupling said r.f. output to said barrel, said barrel acting as the antenna for said transceiver and as a low-impedance secondary load for said toroidal transformer; and d. means for insulating said toroidal transformer coil from said conductive barrel, said toroidal transformer coil extending transversely around said insulating means and barrel.

2. The combination according to claim 1 wherein said coil is mounted around the lower end of said barrel and further including:

means for achieving a resonant match between said r.f. transformer and the transmitter output stage of said transceiver.

3. The combination according to claim 2 wherein said resonance achieving means comprises a first adjustable series-connected capacitor and a second adjustable parallel-connected capacitor interposed between said transformer and the output stage of said transceiver.

4. The combination of claim 3 wherein said weapon is a rifle, said transceiver and said transformer coil being external to said barrel to avoid interference with the operation of said rifle.

* * * * *